US009726163B2

(12) United States Patent
Suzuki et al.

(10) Patent No.: US 9,726,163 B2
(45) Date of Patent: Aug. 8, 2017

(54) VARIABLE DISPLACEMENT SWASH PLATE TYPE COMPRESSOR

(71) Applicant: KABUSHIKI KAISHA TOYOTA JIDOSHOKKI, Aichi-ken (JP)

(72) Inventors: Takahiro Suzuki, Kariya (JP); Shinya Yamamoto, Kariya (JP); Hideharu Yamashita, Kariya (JP); Kazunari Honda, Kariya (JP); Kei Nishii, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 373 days.

(21) Appl. No.: 14/630,887

(22) Filed: Feb. 25, 2015

(65) Prior Publication Data

US 2015/0252798 A1 Sep. 10, 2015

(30) Foreign Application Priority Data

Mar. 10, 2014 (JP) ..... 2014-046563

(51) Int. Cl.
*F04B 1/26* (2006.01)
*F04B 27/18* (2006.01)
(Continued)

(52) U.S. Cl.
CPC ..... *F04B 27/18* (2013.01); *F04B 27/0878* (2013.01); *F04B 27/0895* (2013.01);
(Continued)

(58) Field of Classification Search
CPC .. F04B 27/18; F04B 27/1054; F04B 27/1072; F04B 39/121; F04B 27/0895; F04B 27/0878
(Continued)

(56) References Cited

U.S. PATENT DOCUMENTS 4,037,993 A 7/1977 Roberts
4,061,443 A 12/1977 Black et al.
(Continued)

FOREIGN PATENT DOCUMENTS

JP 52-131204 11/1977
JP 8-105384 4/1996

OTHER PUBLICATIONS

U.S. Appl. No. 14/626,083 to Takahiro Suzuki et al., filed Feb. 19, 2015.

*Primary Examiner* — Charles Freay

(74) *Attorney, Agent, or Firm* — Greenblum & Bernstein, P.L.C.

(57) ABSTRACT

A variable displacement swash plate type compressor includes a rotary shaft, a swash plate, and an actuator. The actuator includes a partition body, a movable body, and a coupling member located radially outward of the rotary shaft of the swash plate. The movable body has a guide surface for changing the inclination angle of the swash plate and a sliding portion that slides on the rotary shaft or the partition body. When viewed in a direction that is perpendicular to a direction in which the rotational axis of the rotary shaft extends and perpendicular to a first direction, the guide surface has a curved shape that is configured such that a normal of the guide surface and the rotational axis of the rotary shaft intersect in a zone surrounded by the sliding portion in the entire range of change in the inclination angle.

5 Claims, 6 Drawing Sheets

(51) Int. Cl.
*F04B 27/08* (2006.01)
*F04B 39/12* (2006.01)
*F04B 27/10* (2006.01)

(52) U.S. Cl.
CPC ..... *F04B 27/1054* (2013.01); *F04B 27/1072* (2013.01); *F04B 39/121* (2013.01)

(58) Field of Classification Search
USPC ..... 92/12.2, 13
See application file for complete search history.

(56) References Cited

U.S. PATENT DOCUMENTS 4,836,090 A * 6/1989 Smith ..... F04B 27/1072
417/222.2
4,963,074 A * 10/1990 Sanuki ..... F04B 27/18
417/222.1
5,002,466 A * 3/1991 Inagaki ..... F04B 27/1072
417/222.1
5,032,060 A * 7/1991 Kobayashi ..... F04B 27/12
417/222.1
5,259,736 A 11/1993 Terauchi
5,380,166 A * 1/1995 Terauchi ..... F04B 27/0878
417/269
5,425,303 A * 6/1995 Shimizu ..... F04B 27/1072
417/269
9,624,919 B2 * 4/2017 Yamamoto ..... F04B 27/086

* cited by examiner

VARIABLE DISPLACEMENT SWASH PLATE TYPE COMPRESSOR

BACKGROUND OF THE INVENTION

The present invention relates to a variable displacement swash plate type compressor.

Such a variable displacement swash plate type compressor is disclosed in Japanese Laid-Open Patent Publication No. 52-131204. This compressor includes a movable body that moves along the axis of a rotary shaft to change the inclination angle of a swash plate. A control pressure chamber is formed in the housing. As control gas is introduced to the control pressure chamber, the pressure inside the control pressure chamber is changed. This allows the movable body to move along the axis of the rotary shaft. As the movable body is moved along the axis of the rotary shaft, the movable body applies to a central portion of the swash plate a force that changes the inclination angle of the swash plate. Accordingly, the inclination of the swash plate is changed.

In the configuration in which a movable body applies a force that changes the inclination angle of a swash plate to a central portion of the swash plate as in the compressor of the above described publication, a great force is required for changing the inclination angle of the swash plate. In this regard, for example, it may be configured such that a movable body applies a force that changes the inclination angle of a swash plate to a peripheral portion of the swash plate. In this case, compared to the case in which a movable body applies a force for changing the swash plate inclination angle to the central portion of the swash plate, the inclination angle can be changed by a small force. This reduces the flow rate of control gas that needs to be introduced to a control pressure chamber to change the inclination angle of the swash plate.

However, in the configuration in which the movable body applies a force for changing the inclination angle of the swash plate to the peripheral portion of the swash plate, a change in the inclination angle of the swash plate causes the movable body to receive a moment that acts to tilt the movable body with respect to the moving direction. If the movable body tilts with respect to the moving direction, a force that supports the tilting motion of the movable body is generated between the movable body and the rotary shaft while the movable body and the rotary shaft are contacting each other at two contact points on the opposite sides of the rotary shaft. The friction caused by the force generates a twist between the movable body and the rotary shaft. The twist increases the sliding resistance, hindering smooth movement of the movable body along the axis of the rotary shaft. This hampers smooth change in the inclination angle of the swash plate.

SUMMARY OF THE INVENTION

Accordingly, it is an objective of the present invention to provide a variable displacement swash plate type compressor that is capable of smoothly changing the inclination angle of the swash plate.

To achieve the foregoing objective and in accordance with one aspect of the present invention, a variable displacement swash plate type compressor is provided that includes a housing, a rotary shaft, a swash plate, a link mechanism, a piston, a conversion mechanism, an actuator, and a control mechanism. The housing has a suction chamber, a discharge chamber, a swash plate chamber communicating with the suction chamber, and a cylinder bore. The rotary shaft is rotationally supported by the housing and has a rotational axis. The swash plate is rotational in the swash plate chamber by rotation of the rotary shaft. The link mechanism is arranged between the rotary shaft and the swash plate and allows change of an inclination angle of the swash plate with respect to a first direction that is perpendicular to the rotational axis of the rotary shaft. The piston is reciprocally received in the cylinder bore. The conversion mechanism causes the piston to reciprocate in the cylinder bore by a stroke corresponding to the inclination angle of the swash plate through rotation of the swash plate. The actuator is located in the swash plate chamber and capable of changing the inclination angle. The control mechanism controls the actuator. The actuator includes a partition body provided on the rotary shaft, a movable body that is located in the swash plate chamber and movable along the rotational axis of the rotary shaft, a control pressure chamber that is defined by the partition body and the movable body and moves the movable body by introducing refrigerant from the discharge chamber, and a coupling member that is located between the movable body and the swash plate and radially outward of the rotary shaft of the swash plate. The movable body includes a guide surface that guides the coupling member and changes the inclination angle of the swash plate as the movable body moves along the rotational axis of the rotary shaft, and a sliding portion that slides on the rotary shaft or the partition body as the movable body moves along the rotational axis of the rotary shaft. When viewed in a direction that is perpendicular to a direction in which the rotational axis of the rotary shaft extends and perpendicular to the first direction, the guide surface has a curved shape that is configured such that a normal of the guide surface and the rotational axis of the rotary shaft intersect in a zone surrounded by the sliding portion in the entire range of change in the inclination angle.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A variable displacement swash plate type compressor according to a first embodiment will now be described with reference to FIGS. 1 to 4. The variable displacement swash plate type compressor is used in a vehicle air conditioner.

Figure 1:
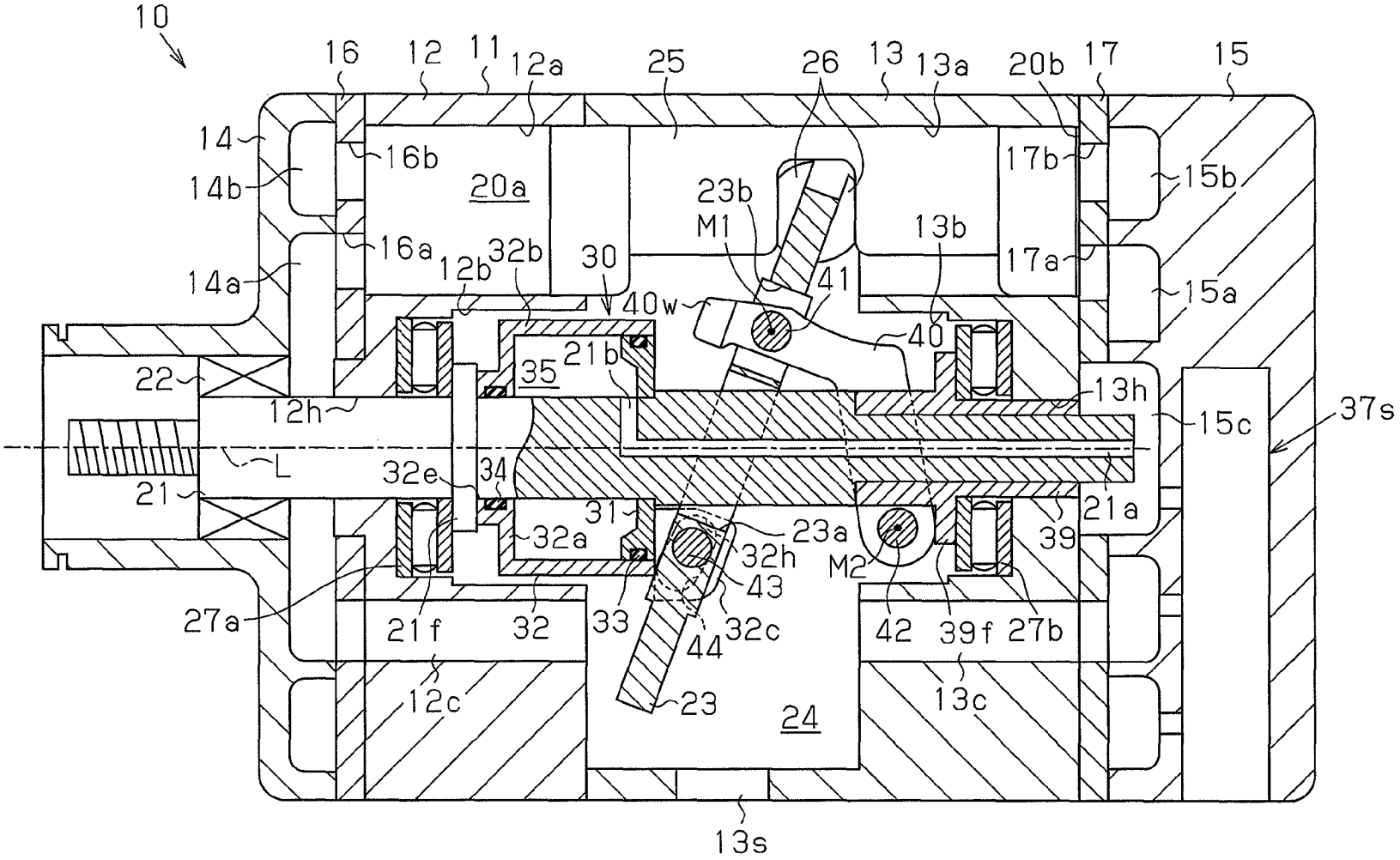
FIG. 1 is a cross-sectional side view illustrating a variable displacement swash plate type compressor according to one embodiment.

As shown in FIG. 1, the variable displacement swash plate type compressor 10 includes a housing 11, which is formed by a first cylinder block 12 located on the front side (first side) and a second cylinder block 13 located on the rear side (second side). The first and second cylinder blocks 12, 13 are joined to each other. The housing 11 further includes a front housing member 14 joined to the first cylinder block 12 and a rear housing member 15 joined to the second cylinder block 13.

A first valve plate 16 is arranged between the front housing member 14 and the first cylinder block 12. Further, a second valve plate 17 is arranged between the rear housing member 15 and the second cylinder block 13.

A suction chamber 14*a* and a discharge chamber 14*b* are defined between the front housing member 14 and the first valve plate 16. The discharge chamber 14*b* is located radially outward of the suction chamber 14*a*. Likewise, a suction chamber 15*a* and a discharge chamber 15*b* are defined between the rear housing member 15 and the second valve plate 17. Additionally, a pressure adjusting chamber 15*c* is formed in the rear housing member 15. The pressure adjusting chamber 15*c* is located at the center of the rear housing member 15, and the suction chamber 15*a* is located radially outward of the pressure adjusting chamber 15*c*. The discharge chamber 15*b* is located radially outward of the suction chamber 15*a*. The discharge chamber 14*b*, 15*b* are connected to each other through a discharge passage (not shown). The discharge passage is in turn connected to an external refrigerant circuit (not shown). The discharge chambers 14*b*, 15*b* are discharge pressure zones.

The first valve plate 16 has suction ports 16*a* connected to the suction chamber 14*a* and discharge ports 16*b* connected to the discharge chamber 14*b*. The second valve plate 17 has suction ports 17*a* connected to the suction chamber 15*a* and discharge ports 17*b* connected to the discharge chamber 15*b*. A suction valve mechanism (not shown) is arranged in each of the suction ports 16*a*, 17*a*. A discharge valve mechanism (not shown) is arranged in each of the discharge ports 16*b*, 17*b*.

A rotary shaft 21 is rotationally supported in the housing 11. A part of the rotary shaft 21 on the front side (first side) extends through a shaft hole 12*h*, which is formed to extend through the first cylinder block 12. Specifically, the front part of the rotary shaft 21 refers to a part of the rotary shaft 21 that is located on the first side in the direction along the rotational axis L of the rotary shaft 21 (the axial direction of the rotary shaft 21). The front end of the rotary shaft 21 is located in the front housing member 14. A part of the rotary shaft 21 on the rear side (second side) extends through a shaft hole 13*h*, which is formed in the second cylinder block 13. Specifically, the rear part of the rotary shaft 21 refers to a part of the rotary shaft 21 that is located on the second side in the direction in which the rotational axis L of the rotary shaft 21 extends. The rear end of the rotary shaft 21 is located in the pressure adjusting chamber 15*c*.

The front part of the rotary shaft 21 is rotationally supported by the first cylinder block 12 at the shaft hole 12*h*. The rear part of the rotary shaft 21 is rotationally supported by the second cylinder block 13 at the shaft hole 13*h*. A sealing device 22 of lip seal type is located between the front housing member 14 and the rotary shaft 21. The front end of the rotary shaft 21 is connected to and driven by an external drive source, which is a vehicle engine in this embodiment, through a power transmission mechanism (not shown). In the present embodiment, the power transmission mechanism PT is a clutchless mechanism, which constantly transmits power. The power transmission mechanism is, for example, a combination of a belt and pulleys.

In the housing 11, the first cylinder block 12 and the second cylinder block 13 define a swash plate chamber 24. A swash plate 23 is accommodated in the swash plate chamber 24. The swash plate 23 receives drive force from the rotary shaft 21 to be rotated. The swash plate 23 also tilts along the axis L of the rotary shaft 21 with respect to the rotary shaft 21. The swash plate 23 has an insertion hole 23*a*, through which the rotary shaft 21 can extends. The swash plate 23 is assembled to the rotary shaft 21 by inserting the rotary shaft 21 into the insertion hole 23*a*.

The first cylinder block 12 has first cylinder bores 12*a* (only one of the first cylinder bores 12*a* is illustrated in FIG. 1), which extend along the axis of the first cylinder block 12 and are arranged about the rotary shaft 21. Each first cylinder bore 12*a* is connected to the suction chamber 14*a* via the corresponding suction port 16*a* and is connected to the discharge chamber 14*b* via the corresponding discharge port 16*b*. The second cylinder block 13 has second cylinder bores 13*a* (only one of the second cylinder bores 13*a* is illustrated in FIG. 1), which extend along the axis of the second cylinder block 13 and are arranged about the rotary shaft 21. Each second cylinder bore 13*a* is connected to the suction chamber 15*a* via the corresponding suction port 17*a* and is connected to the discharge chamber 15*b* via the corresponding discharge port 17*b*. The first cylinder bores 12*a* and the second cylinder bores 13*a* are arranged to make front-rear pairs. Each pair of the first cylinder bore 12*a* and the second cylinder bore 13*a* accommodates a double-headed piston 25, while permitting the piston 25 to reciprocate in the front-rear direction. That is, the variable displacement swash plate type compressor 10 of the present embodiment is a double-headed piston swash plate type compressor.

Each double-headed piston 25 is engaged with the periphery of the swash plate 23 with two shoes 26. The shoes 26 convert rotation of the swash plate 23, which rotates with the rotary shaft 21, to linear reciprocation of the double-headed pistons 25. Thus, the pairs of the shoes 26 function as a conversion mechanism that reciprocates the double-headed pistons 25 in the pairs of the first cylinder bores 12*a* and the second cylinder bores 13*a* as the swash plate 23 rotates. In each first cylinder bore 12*a*, a first compression chamber 20*a* is defined by the double-headed piston 25 and the first valve plate 16. In each second cylinder bore 13*a*, a second compression chamber 20*b* is defined by the double-headed piston 25 and the second valve plate 17.

The first cylinder block 12 has a first large diameter hole 12*b*, which is continuous with the shaft hole 12*h* and has a larger diameter than the shaft hole 12*h*. The first large diameter hole 12*b* communicates with the swash plate chamber 24. The swash plate chamber 24 and the suction chamber 14*a* are connected to each other by a suction passage 12*c*, which extends through the first cylinder block 12 and the first valve plate 16.

The second cylinder block 13 has a second large diameter hole 13*b*, which is continuous with the shaft hole 13*h* and has a larger diameter than the shaft hole 13*h*. The second large diameter hole 13*b* communicates with the swash plate chamber 24. The swash plate chamber 24 and the suction chamber 15*a* are connected to each other by a suction passage 13*c*, which extends through the second cylinder block 13 and the second valve plate 17.

A suction inlet 13*s* is formed in the peripheral wall of the second cylinder block 13. The suction inlet 13*s* is connected to the external refrigerant circuit. Refrigerant gas is drawn into the swash plate chamber 24 from the external refrigerant circuit via the suction inlet 13*s* and is then drawn into the suction chambers 14*a*, 15*a* via the suction passages 12*c*, 13*c*. The suction chambers 14*a*, 15*a* and the swash plate chamber 24 are therefore in a suction pressure zone. The pressure in the suction chambers 14*a*, 15*a* and the pressure in the swash plate chamber 24 are substantially equal to each other.

The rotary shaft 21 has an annular flange portion 21*f*, which extends in the radial direction. The flange portion 21*f* is arranged in the first large diameter hole 12*b*. With respect to the axial direction of the rotary shaft 21, a first thrust bearing 27*a* is arranged between the flange portion 21*f* and the first cylinder block 12. A cylindrical supporting member 39 is press fitted to a rear portion of the rotary shaft 21. The supporting member 39 has an annular flange portion 39*f*, which extends in the radial direction. The flange portion 39*f* is arranged in the second large diameter hole 13*b*. With respect to the axial direction of the rotary shaft 21, a second thrust bearing 27*b* is arranged between the flange portion 39*f* and the second cylinder block 13.

The swash plate chamber 24 houses an actuator 30 that is capable of changing the inclination angle of the swash plate 23. The inclination angle of the swash plate 23 is changeable with respect to a first direction (the vertical direction as viewed in FIG. 1), which is perpendicular to the rotational axis L of the rotary shaft 21. The actuator 30 is located on the rotary shaft 21 and between the flange portion 21*f* and the swash plate 23. The actuator 30 includes an annular partition body 31, which rotates integrally with the rotary shaft 21. The actuator 30 also includes a cylindrical movable body 32, which has a closed end.

The movable body 32 is formed by an annular bottom portion 32*a* and a cylindrical portion 32*b*. A through hole 32*e* is formed in the bottom portion 32*a* to receive the rotary shaft 21. The cylindrical portion 32*b* extends along the axis of the rotary shaft 21 from the peripheral edge of the bottom portion 32*a*. The inner circumferential surface of the cylindrical portion 32*b* is slidable along the outer circumferential surface of the partition body 31. This allows the movable body 32 to rotate integrally with the rotary shaft 21 via the partition body 31. The clearance between the inner circumferential surface of the cylindrical portion 32*b* and the outer circumferential surface of the partition body 31 is sealed by a sealing member 33. The clearance between the through hole 32*e* and the rotary shaft 21 is sealed by a sealing member 34. The actuator 30 has a control pressure chamber 35 defined by the partition body 31 and the movable body 32.

A first in-shaft passage 21*a* is formed in the rotary shaft 21. The first in-shaft passage 21*a* extends along the axis L of the rotary shaft 21. The rear end of the first in-shaft passage 21*a* is opened to the interior of the pressure adjusting chamber 15*c*. A second in-shaft passage 21*b* is formed in the rotary shaft 21. The second in-shaft passage 21*b* extends in the radial direction of the rotary shaft 21. One end of the second in-shaft passage 21*b* communicates with the first in-shaft passage 21*a*. The other end of the second in-shaft passage 21*b* is opened to the interior of the control pressure chamber 35. Accordingly, the control pressure chamber 35 and the pressure adjusting chamber 15*c* are connected to each other by the first in-shaft passage 21*a* and the second in-shaft passage 21*b*.

Figure 2:
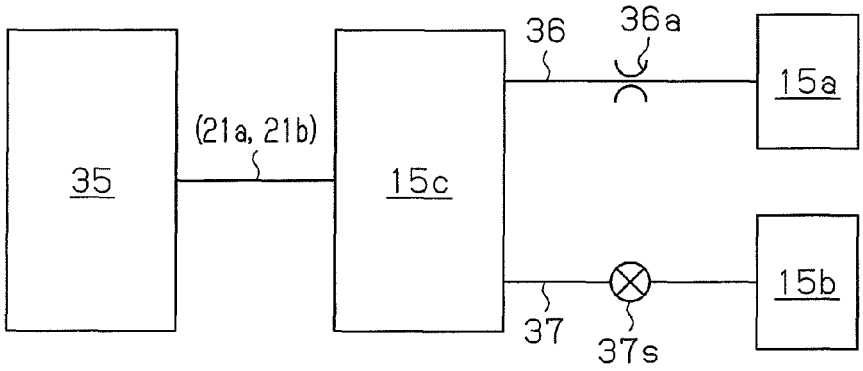
FIG. 2 is a diagram showing the relationship among a control pressure chamber, a pressure adjusting chamber, a suction chamber, and a discharge chamber.

As shown in FIG. 2, the pressure adjusting chamber 15*c* and the suction chamber 15*a* are connected to each other by the bleed passage 36. The bleed passage 36 has an orifice 36*a*. The orifice 36*a* restricts the flow rate of refrigerant gas flowing in the bleed passage 36. The pressure adjusting chamber 15*c* and the discharge chamber 15*b* are connected to each other by a supply passage 37. An electromagnetic control valve 37*s*, which serves as a control mechanism for controlling the actuator 30, is arranged in the supply passage 37. The control valve 37*s* is capable of adjusting the opening degree of the supply passage 37 based on the pressure in the suction chamber 15*a*. The control valve 37*s* adjusts the flow rate of refrigerant gas flowing in the supply passage 37.

Refrigerant gas is introduced to the control pressure chamber 35 from the discharge chamber 15*b* via the supply passage 37, the pressure adjusting chamber 15*c*, the first in-shaft passage 21*a*, and the second in-shaft passage 21*b*. Also, refrigerant gas is discharged from the control pressure chamber 35 to the suction chamber 15*a* via the second in-shaft passage 21*b*, the first in-shaft passage 21*a*, the pressure adjusting chamber 15*c*, and the bleed passage 36. Accordingly, the pressure inside the control pressure chamber is changed. The pressure difference between the control pressure chamber 35 and the swash plate chamber 24 causes the movable body 32 to move along the axis of the rotary shaft 21 with respect to the partition body 31. The refrigerant gas introduced into the control pressure chamber 35 serves as control gas for controlling the movement of the movable body 32.

In the swash plate chamber 24, a lug arm 40 is provided between the swash plate 23 and the flange portion 39*f*. The lug arm 40 serves as a link mechanism that allows change of the inclination angle of the swash plate 23. The lug arm 40 is substantially L-shaped and extends vertically as viewed in FIG. 1. The lug arm 40 has a weight portion 40*w* formed at one end (upper end). The weight portion 40*w* is passed through a groove 23*b* of the swash plate 23 to be located to a position in front of the swash plate 23.

The upper portion of the lug arm 40 is coupled to the upper portion (as viewed in FIG. 1) of the swash plate 23 by a columnar first pin 41, which extends across the groove 23*b*. This structure allows the upper portion of the lug arm 40 to be supported by the swash plate 23 such that the upper portion of the lug arm 40 can pivot about a first pivot axis M1, which coincides with the axis of the first pin 41. A lower portion of the lug arm 40 is coupled to the supporting member 39 by a columnar second pin 42. This structure allows the lower portion of the lug arm 40 to be supported by the supporting member 39 such that the lower portion of the lug arm 40 can pivot about a second pivot axis M2, which coincides with the axis of the second pin 42.

A coupling portion 32*c* is formed at the distal end of the cylindrical portion 32*b* of the movable body 32. The coupling portion 32*c* protrudes toward the swash plate 23. The coupling portion 32*c* has an elongated insertion hole 32*h* for receiving a columnar coupling pin 43. The coupling pin 43, which serves as a coupling member, is located on the swash plate 23 at a position radially outward of the rotary shaft 21, that is, on the lower side as viewed in FIG. 1. The coupling pin 43 is press fitted to the lower part of the swash plate 23. The coupling pin 43 couples the coupling portion 32*c* to the lower part of the swash plate 23.

Figure 3:
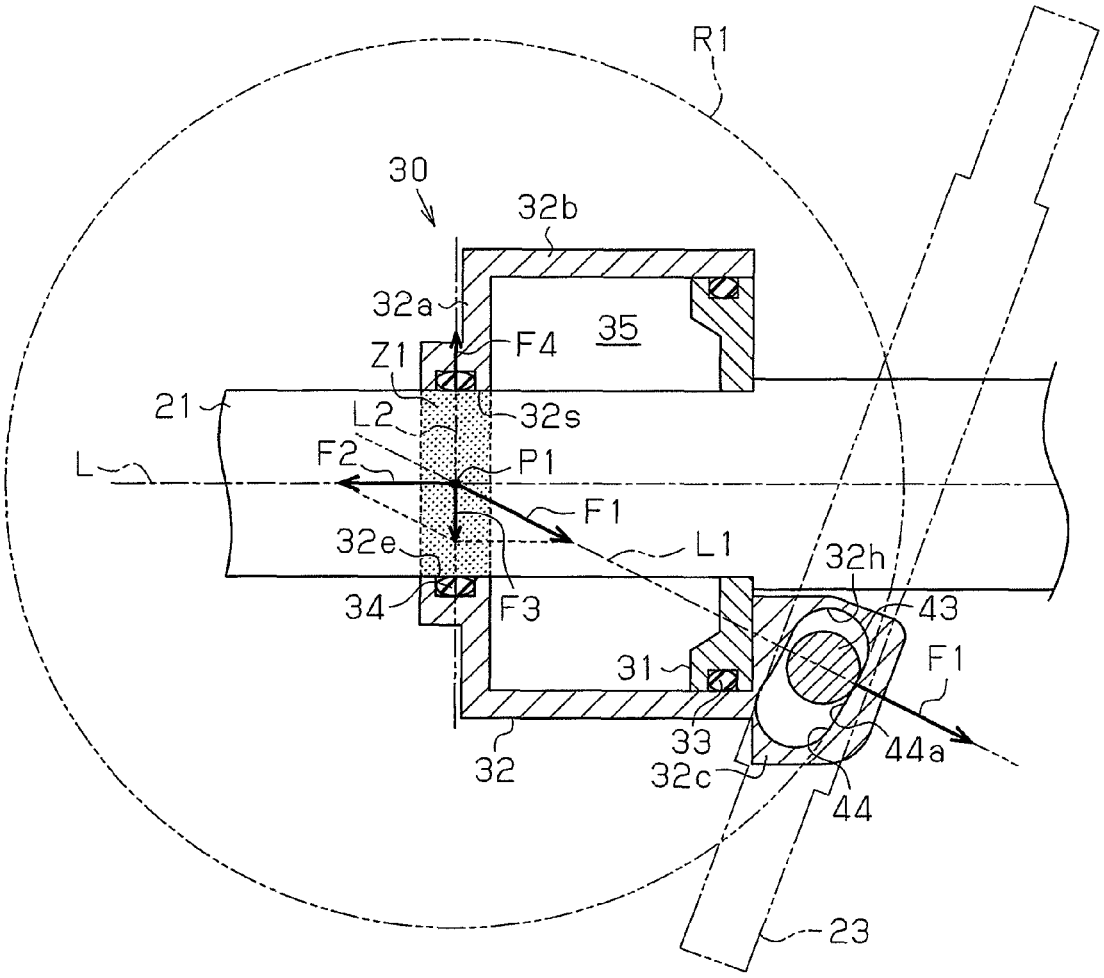
FIG. 3 is a cross-sectional side view illustrating a coupling pin and its surrounding.

As shown in FIG. 3, the insertion hole 32*h* has a guide surface 44. The guide surface 44 guides the coupling pin 43 and changes the inclination angle of the swash plate 23 as the movable body 32 moves along the axis of the rotary shaft 21. The guide surface 44 is located on the opposite side of the insertion hole 32*h* with respect to the movable body 32. The guide surface 44 has a curved portion 44*a* formed as a curved surface. The curved portion 44*a* has a shape of a single arc that corresponds to an imaginary circle R1, the center of which is located on the rotational axis L of the rotary shaft 21. That is, the curved portion 44*a* is a part of the imaginary circle R1.

The movable body 32 has a sliding portion 32*s*, which slides along the rotary shaft 21 as the movable body 32 moves along the axis of the rotary shaft 21. In the present embodiment, the sliding portion 32*s* is the inner circumferential surface of the through hole 32*e* and extends along the axis of the rotary shaft 21.

The point at which a normal L1 of the curved portion 44*a* intersects the rotational axis L of the rotary shaft 21 as the inclination angle of the swash plate 23 changes is defined as an intersection P1. The force that is applied to the movable body 32 by the coupling pin 43 in the curved portion 44*a* is represented by F1. It is assumed that the actuator 30 is viewed in the direction that is perpendicular to the direction in which the rotational axis L of the rotary shaft 21 extends and perpendicular to the first direction. That is, it is assumed that the actuator 30 is viewed in a direction perpendicular to the elevation of FIG. 3. In this case, the intersection P1 is located in a zone Z1 surrounded by the sliding portion 32*s* in the entire range of change in the inclination angle of the swash plate 23. That is, the curved portion 44*a* has a shape of a single arc that corresponds to the imaginary circle R1, the center of which coincides with the intersection P1. The zone Z1 is surrounded by the sliding portion 32*s* in the axial direction of the rotary shaft 21 and is a dotted region in FIG. 3.

In the variable displacement swash plate type compressor 10, which has the above described configuration, reduction in the opening degree of the control valve 37*s* reduces the flow rate of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. Since the refrigerant gas is delivered to the suction chamber 15*a* from the control pressure chamber 35 via the second in-shaft passage 21*b*, the first in-shaft passage 21*a*, the pressure adjusting chamber 15*c*, and the bleed passage 36, the pressure in the control pressure chamber 35 and the pressure in the suction chamber 15*a* are substantially equalized. Since the pressure difference between the control pressure chamber 35 and the swash plate chamber 24 is reduced, the compression reactive force acting on the swash plate 23 causes the swash plate 23 to pull the movable body 32 via the coupling pin 43. This moves the movable body 32 such that the bottom portion 32*a* of the movable body 32 approaches the partition body 31.

Figure 4:
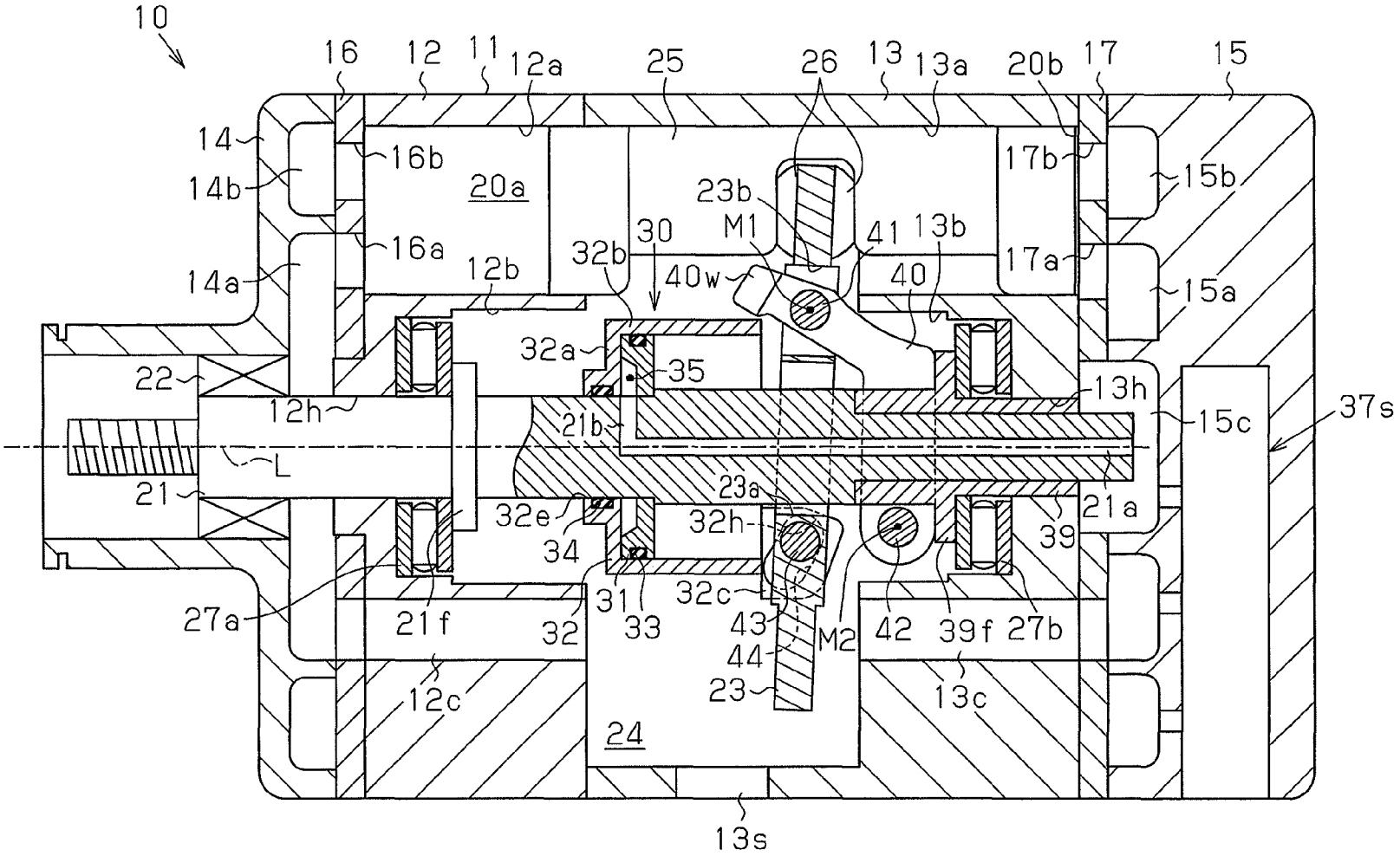
FIG. 4 is a cross-sectional side view illustrating the variable displacement swash plate type compressor when the inclination angle of the swash plate is minimized.

When the movable body 32 is moved such that the bottom portion 32*a* of the movable body 32 approaches the partition body 31 as shown in FIG. 4, the coupling pin 43 slides inside the insertion hole 32*h*. Simultaneously, the swash plate 23 pivots about the first pivot axis M1. As the swash plate 23 pivots about the first pivot axis M1, the lug arm 40 pivots about the second pivot axis M2. The lug arm 40 thus approaches the flange portion 39*f*. This reduces the inclination angle of the swash plate 23 and thus reduces the stroke of the double-headed pistons 25. Accordingly, the displacement is decreased.

Increase in the opening degree of the control valve 37*s* increases the flow rate of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. This substantially equalizes the pressure in the control pressure chamber 35 to the pressure in the discharge chamber 15*b*. Thus, an increase in the pressure difference between the control pressure chamber 35 and the swash plate chamber 24 causes the movable body 32 to pull the swash plate 23 via the coupling pin 43. This moves the bottom portion 32*a* of the movable body 32 away from the partition body 31.

When the movable body 32 is moved such that the bottom portion 32*a* of the movable body 32 separates away from the partition body 31 as shown in FIG. 1, the coupling pin 43 slides inside the insertion hole 32*h*. This causes the swash plate 23 to pivot about the first pivot axis M1 in a direction opposite to the pivoting direction for decreasing the inclination angle of the swash plate 23. As the swash plate 23 pivots about the first pivot axis M1 in a direction opposite to the inclination angle decreasing direction, the lug arm 40 pivots about the second pivot axis M2 in a direction opposite to the pivoting direction for decreasing the inclination angle of the swash plate 23. The lug arm 40 thus moves away from the flange portion 39*f*. This increases the inclination angle of the swash plate 23 and thus increases the stroke of the double-headed pistons 25. Accordingly, the displacement is increased.

Operation of the present embodiment will now be described.

As shown in FIG. 3, the intersection P1 is located in a zone Z1 surrounded by the sliding portion 32*s* in the entire range of change in the inclination angle of the swash plate 23 in the axial direction of the rotary shaft 21. At this time, a resultant force F3 is generated on a vertical line L2 containing the intersection P1. The resultant force F3 is obtained by combining a force F1 that is applied to the movable body 32 by the coupling pin 43 in the curved portion 44*a* and a force F2 that is generated by the pressure in the control pressure chamber 35 to move the movable body 32 in the axial direction of the rotary shaft 21. The vertical line L2 extends in the first direction. A force F4 that in the opposite direction and balances with the resultant force F3 is also generated on the vertical line L2. As a result, the all the forces acting on the movable body 32 are generated on the vertical line, which includes the intersection P1, and balance out. Therefore, in the entire range of change in the inclination angle, the movable body 32 receives no moment that acts to tilt the movable body 32 with respect to the moving direction. Thus, the inclination angle of the swash plate 23 is changed smoothly.

The above described embodiment provides the following advantages.

(1) It is assumed that the actuator 30 is viewed in the direction that is perpendicular to the direction in which the rotational axis L of the rotary shaft 21 extends and perpendicular to the first direction. In this case, the curved portion 44*a* has a curved shape that is set such that, in the entire range of change in the inclination angle of the swash plate 23, the normal L1 of the curved portion 44*a* and the rotational axis L of the rotary shaft 21 intersect in the zone Z1 surrounded by the sliding portion 32*s*.

According to this configuration, when the inclination angle of the swash plate 23 is changed, the intersection P1 of the normal L1 of the curved portion 44*a* and the rotational axis L of the rotary shaft 21 is located in the zone Z1, which is surrounded by the sliding portion 32*s* in the axial direction of the rotary shaft 21. At this time, the force F1 acts along the normal L1 and on the movable body 32 from the coupling pin 43 in the curved portion 44*a*. The force F2 is generated by the pressure in the control pressure chamber 35 and acts on the movable body 32 to move the movable body 32 in the axial direction of the rotary shaft 21. The resultant force F3 of the force F1 and the force F2 is generated on the vertical line L2, which includes the intersection P1. A force F4 that in the opposite direction and balances with the resultant force F3 is also generated on the vertical line L2.

As a result, the all the forces acting on the movable body 32 are generated on the vertical line, which includes the intersection P1, and balance out. Therefore, in the entire range of change in the inclination angle of the swash plate, the movable body 32 receives no moment that acts to tilt the movable body 32 with respect to the moving direction. Therefore, the inclination angle of the swash plate 23 is changed smoothly.

(2) The curved portion 44*a* has a shape of a single arc the center of which is the intersection P1, which is a predetermined point on the rotational axis L of the rotary shaft 21. That is, to reduce the moment that acts to tilt the movable body 32 with respect to the moving direction, it is simply sufficient to make the curved portion 44*a* to have the shape of a single arc the center of which coincides with the intersection P1 located on the rotational axis L1 of the rotary shaft 21. This improves the productivity.

(3) Unlike a variable displacement swash plate type compressor that includes single-headed pistons, the double-headed piston swash plate type compressor, which has the double-headed pistons 25, cannot use the swash plate chamber 24 as a control pressure chamber to change the inclination angle of the swash plate 23. Thus, in the present embodiment, the inclination angle of the swash plate 23 is changed by changing the pressure in the control pressure chamber 35 defined by the movable body 32. Since the control pressure chamber 35 is a small space compared to the swash plate chamber 24, only a small amount of refrigerant gas needs to be introduced to the control pressure chamber 35. This improves the response of change in the inclination angle of the swash plate 23. Since the present embodiment allows the inclination angle of the swash plate 23 to be smoothly changed, the amount of refrigerant gas introduced to the inside of the control pressure chamber 35 is not unnecessarily increased.

The above embodiment may be modified as follows.

Figure 5:
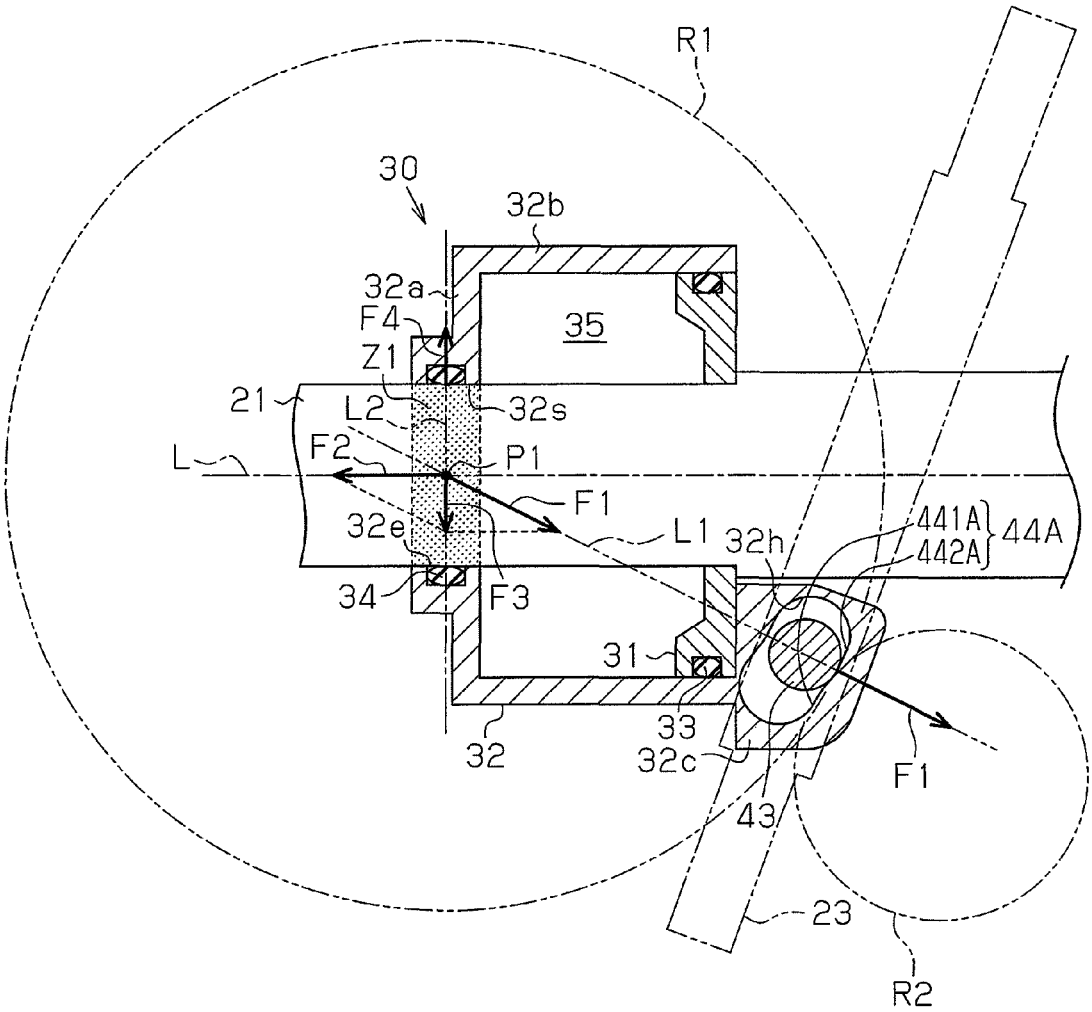
FIG. 5 is a cross-sectional side view illustrating a coupling pin and its surrounding according to another embodiment.
Figure 6:
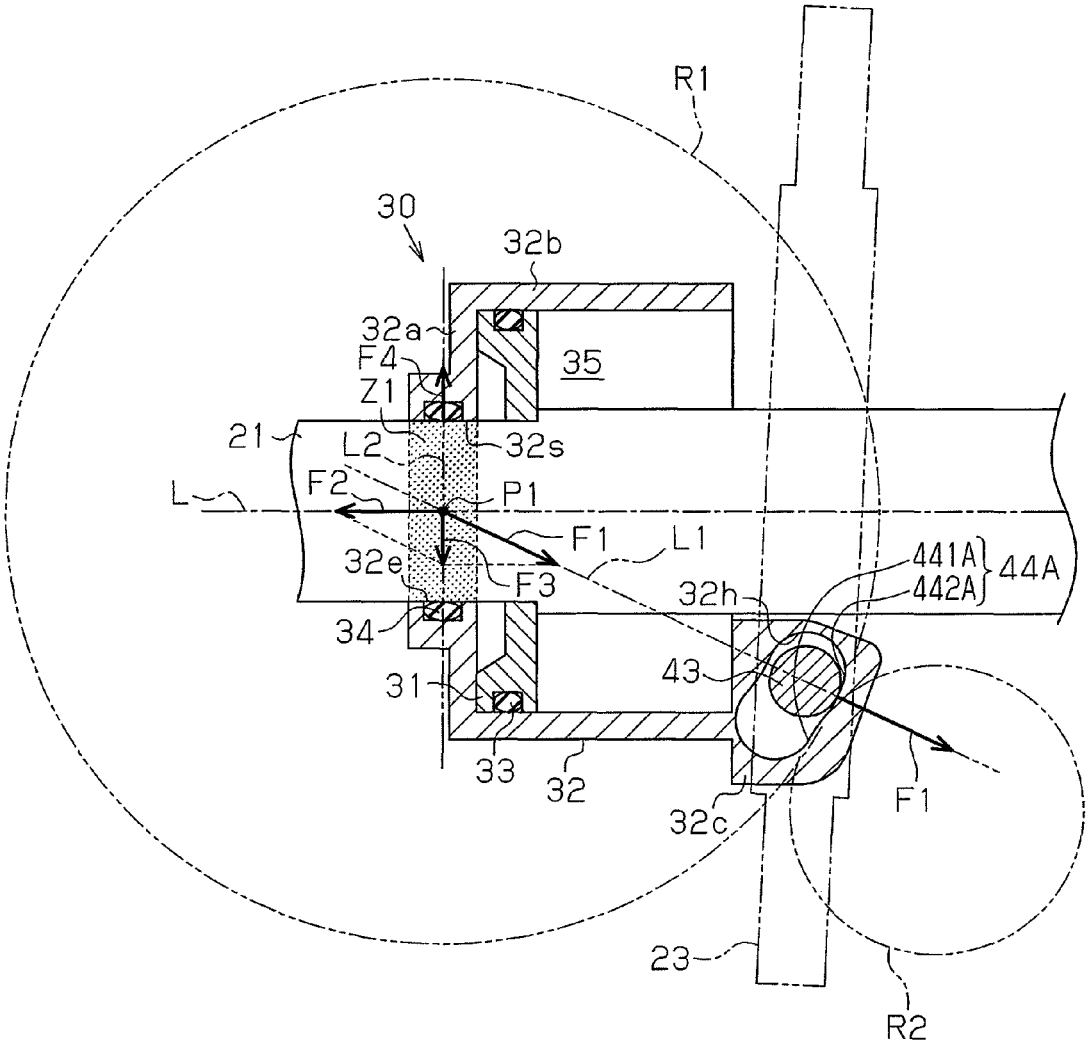
FIG. 6 is a cross-sectional side view illustrating the coupling pin and its surrounding according to the embodiment of FIG. 5.

As shown in FIGS. 5 and 6, a guide surface 44A may include a convex portion 441A that bulges toward the zone Z1, which is surrounded by the sliding portion 32*s*, and a concave portion 442A, which extends away from the zone Z1. The convex portion 441A has an arcuate shape that corresponds to an imaginary circle R2, which is different from the imaginary circle R1. The concave portion 442A has the shape of an arc that corresponds to the imaginary circle R1 the center of which coincides with the intersection P1. The convex portion 441A and the concave portion 442A are continuous with each other.

When the inclination angle of the swash plate 23 increases, the coupling pin 43 is guided by the convex portion 441A. When the inclination angle of the swash plate 23 decreases, the coupling pin 43 is guided by the concave portion 442A. In this configuration, as the inclination angle of the swash plate 23 changes, the magnitude and the direction of the force F1, which acts on the movable body 32 from the coupling pin 43, can be adjusted. Thus, to smoothly move the movable body 32, the force acting on the movable body 32 can be tuned at each desired inclination angle.

Figure 7:
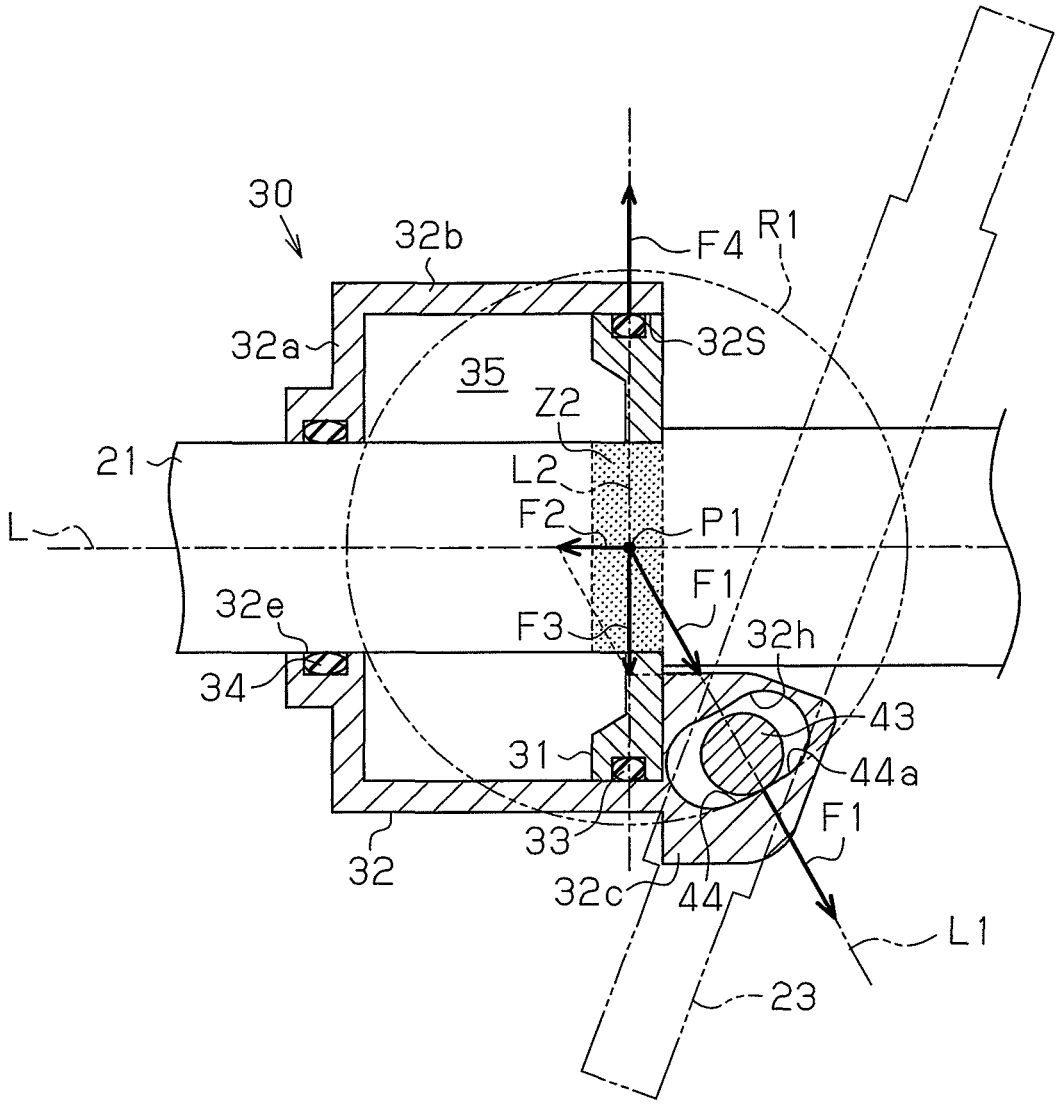
FIG. 7 is a cross-sectional side view illustrating a coupling pin and its surrounding according to a further embodiment.

As shown in FIG. 7, the curved portion 44*a* may be configured such that the intersection P1 is located in a zone Z2, which is surrounded by a sliding portion 32S that slides on the partition body 31 as the movable body 32 moves in the axial direction of the rotary shaft 21.

In place of the insertion hole 32*h*, the coupling portion 32*c* may have a groove into which the coupling pin 43 can be inserted.

The coupling pin 43 may be fixed to the lower part of the swash plate 23 with screws.

The coupling pin 43 does not necessary need to be fixed to the lower part of the swash plate 23, but may be inserted into an insertion hole formed in the lower part of the swash plate 23 and slidably held there.

An orifice may be formed in the supply passage 37, which connects the pressure adjusting chamber 15*c* and the discharge chamber 15*b* with each other, and an electromagnetic control valve 37*s* may be provided on the bleed passage 36, which connects the pressure adjusting chamber 15*c* and the suction chamber 15*a* with each other.

The variable displacement swash plate type compressor 10 is a double-headed piston swash plate type compressor having the double-headed pistons 25, but may be a single-headed piston swash plate type compressor having single-headed pistons.

Drive power may be obtained from an external drive source via a clutch.

Therefore, the present examples and embodiments are to be considered as illustrative and not restrictive and the invention is not to be limited to the details given herein, but may be modified within the scope and equivalence of the appended claims.

The invention claimed is:

1. A variable displacement swash plate type compressor comprising:

a housing that has a suction chamber, a discharge chamber, a swash plate chamber communicating with the suction chamber, and a cylinder bore;

a rotary shaft that is rotationally supported by the housing and has a rotational axis;

a swash plate that is rotational in the swash plate chamber by rotation of the rotary shaft;

a link mechanism that is arranged between the rotary shaft and the swash plate and allows change of an inclination angle of the swash plate with respect to a first direction that is perpendicular to the rotational axis of the rotary shaft over a range of change in the inclination angle;

a piston reciprocally received in the cylinder bore;

a conversion mechanism that causes the piston to reciprocate in the cylinder bore by a stroke corresponding to the inclination angle of the swash plate through rotation of the swash plate;

an actuator that is located in the swash plate chamber and capable of changing the inclination angle; and a control mechanism that controls the actuator, wherein the actuator includes a partition body provided on the rotary shaft, a movable body that is located in the swash plate chamber and movable along the rotational axis of the rotary shaft, a control pressure chamber that is defined by the partition body and the movable body and moves the movable body by introducing gas from the discharge chamber or discharging gas to the suction chamber, and a coupling member that is located between the movable body and the swash plate and radially outward of the rotary shaft of the swash plate, the movable body includes:

a guide surface that guides the coupling member and changes the inclination angle of the swash plate as the movable body moves along the rotational axis of the rotary shaft, and a sliding portion that slides on the rotary shaft or the partition body as the movable body moves along the rotational axis of the rotary shaft, and when viewed in a direction that is perpendicular to a direction in which the rotational axis of the rotary shaft extends and perpendicular to the first direction, the guide surface has a curved shape that is configured such that a normal of the guide surface and the rotational axis of the rotary shaft intersect in a zone surrounded by the sliding portion over the entire range of change in the inclination angle.

2. The variable displacement swash plate type compressor according to claim 1, wherein the curved shape is a shape of a single arc the center of which is a predetermined point on the rotational axis of the rotary shaft.

3. The variable displacement swash plate type compressor according to claim 1, wherein the guide surface includes a convex portion that bulges toward the zone surrounded by the sliding portion, and a concave portion that extends away from the zone surrounded by the sliding portion, the coupling member is guided by the convex portion when the inclination angle is increased, and the coupling member is guided by the concave portion when the inclination angle is decreased.

4. The variable displacement swash plate type compressor according to claim 1, wherein a normal of the guide surface and the rotational axis of the rotary shaft intersect at an intersection, the guide surface has a curved portion, and a resultant force is generated on a line that contains the intersection and extends in the first direction, wherein the resultant force is obtained by combining a force that is applied to the movable body by the coupling member in contact with the curved portion and a force that is generated by a pressure in the control pressure chamber to move the movable body in the axial direction of the rotary shaft.

5. The variable displacement swash plate type compressor according to claim 4, wherein the curved portion has a shape of a single arc that corresponds to an imaginary circle the center of which is located on the rotational axis of the rotary shaft.

* * * * *